US005701249A

United States Patent [19]

Berson

[11] Patent Number: 5,701,249

[45] Date of Patent: Dec. 23, 1997

[54] SERVICE AND USAGE DATA COLLECTION USING A SPECIAL MAIL PIECE

[75] Inventor: William Berson, Weston, Conn.

[73] Assignee: Pitney Bowes Inc., Stamford, Conn.

[21] Appl. No.: 408,801

[22] Filed: Mar. 23, 1995

[51] Int. Cl.[6] ..... G07B 17/00; G07B 17/02

[52] U.S. Cl. ..... 364/464.18; 364/464.14; 364/464.2; 364/551.01

[58] Field of Search ..... 364/551.01, 464.01, 364/464.02, 464.03, 464.04, 551.02, 464.18, 464.14, 464.2

[56] References Cited

U.S. PATENT DOCUMENTS

| | | | |
|---|---|---|---|
| 4,180,856 | 12/1979 | Check, Jr. et al. | 364/466 |
| 4,760,532 | 7/1988 | Sansone et al. | 364/464.03 |
| 4,811,234 | 3/1989 | Storace | 364/464.02 |
| 4,812,965 | 3/1989 | Taylor | 364/550 |
| 4,829,568 | 5/1989 | Clark et al. | 380/23 |
| 4,835,713 | 5/1989 | Pastor | 364/519 |
| 4,837,701 | 6/1989 | Sansone et al. | 364/464.03 |
| 4,907,162 | 3/1990 | Fougere | 364/464.02 |
| 4,908,768 | 3/1990 | Gelfer et al. | 364/464.03 |
| 4,949,381 | 8/1990 | Pastor | 380/51 |
| 5,075,862 | 12/1991 | Doeberl et al. | 395/117 |
| 5,202,834 | 4/1993 | Gilham | 364/464.02 |
| 5,229,932 | 7/1993 | Connell et al. | 364/401 |
| 5,457,642 | 10/1995 | Brookner | 364/569 |
| 5,508,933 | 4/1996 | Abumehdi | 364/464.02 |

*Primary Examiner*—Edward R. Cosimano
*Assistant Examiner*—Bryan Bui
*Attorney, Agent, or Firm*—Ronald Reichman; Melvin J. Scolnick

[57] ABSTRACT

A monitoring system that determines the amount and type of customers' usage of machines and equipment without having a representative of the manufacturer physically inspect the customers machines and equipment. The monitoring system utilizes a mailpiece to transmit information about the customers' usage of customers machines and equipment.

9 Claims, 3 Drawing Sheets

SERVICE AND USAGE DATA COLLECTION USING A SPECIAL MAIL PIECE

FIELD OF THE INVENTION

The invention relates generally to the field of monitoring systems and more particularly to a monitoring system that utilizes a mailpiece.

BACKGROUND OF THE INVENTION

Some machines and equipment currently in use are complex and expensive to operate. Often the machines and equipment may contain features that particular customers do not want to use or want to use for limited times or at off hours. Owners of the machines and equipment have attempted to satisfy their customers need by instituting billings that are dependent upon the use of various features of the machine and/or the hours in which the selected features were used.

Mailing machines are complex machines that have been developed to automate the process of sealing, weighing and stacking of outgoing mail. An example of a complex mailing machine is the Paragon™ mailing machine. The Paragon mailing machine is manufactured by Pitney Bowes. Some customers do not want to use all of the features of Paragon and the manufacturer of Paragon would like to charge the users of Paragon only for the features that the customer is using. Currently there is no way of determining which feature a customer is using or not using without a on line data telecommunications connection or an on line inspection of the machine by a representative of the manufacturer.

One of the disadvantages of an on line data telecommunications connection is that the connection requires a modem and access to a phone line. Data telecommunications are also relatively expensive.

A disadvantage of on line inspections by representatives of the manufacturer is that such inspections are time consuming and expensive.

In order for machines and equipment to remain operational the machines and equipment must be repaired and maintained by maintenance workers. Another disadvantage of the prior art is that maintenance calls are scheduled chronology when the need for servicing of a machine or piece of equipment is a function of time.

SUMMARY OF THE INVENTION

This invention overcomes the disadvantages of the prior art by providing a monitoring system that determines the amount and type of customers' usage of machines and equipment without having a representative of the manufacturer physically inspect the customers machines and equipment. The monitoring system of this invention also does not use telecommunications equipment to monitor the customers machines and equipment.

An advantage of this invention is that the customer may be charged for only those features of the machines and equipment that the customer actually uses.

An additional advantage of this invention is that the manufacture of the machines and equipment will receive information about the manufactures machines and equipment that will allow the manufacturer to better serve the customer and perhaps design new and improved features for the machines and equipment.

DETAILED DESCRIPTION OF THE PREFERRED EMBODIMENT

Figure 1:
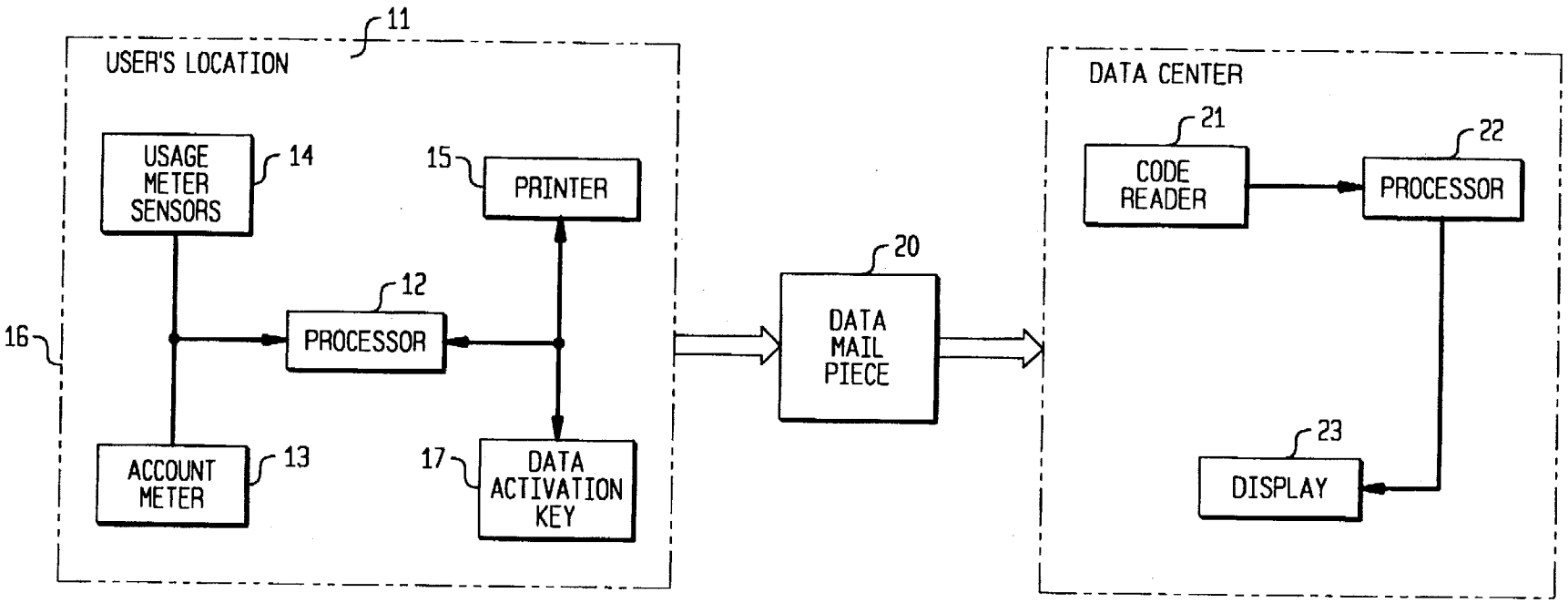
FIG. 1 is a block drawing of the apparatus of this invention being utilized to monitor mailing equipment.

Referring now to the drawings in detail, and more particularly to FIG. 1, the reference character 11 represents a postal dispensing apparatus that is located at a users location. Postal dispensing apparatus 11 includes: a processor 12; a account meter 13 that includes an ascending register and a descending register, that are coupled to processor 12; usage meter sensors 14, that are coupled to processor 12 and account meter 13; a printer 15 that is coupled to processor 12; a data activation key 17 that is coupled to processor 12 and printer 15; and a housing 16 that encloses the above components.

As is known in the art, the ascending register maintains a record of all the postage dispensed by the postage dispensing apparatus 11 and the descending register maintains a record of the amount of postage that has been purchased by the user and which is available to be dispensed. Processor 12 may be any of a number of commercially available processors such as a model 80386 microprocessor available from Intel Corporation or a TMS 320/C25 processor available from Texas Instruments Corporation. Usage meter sensors 14 are connected to the processor 12 and account meter 13.

Sensors 14 sense various characteristics of the mailpieces in which a postal indicia is going to be affixed. For instance, sensors 14 will sense the weight, size, class, thickness, etc. of the mailpieces.

Processor 12 is in communication with printer 15. Printer 16 will receive commands from processor 12 for the amount of postage to be dispensed and other data which is printed on mailpiece 20.

Periodically, postal dispensing apparatus 11 is inspected by the enabling of activation key 17. Activation key 17 may be a physical key or a code that is inputted to processor 12 to output information 31 (hereinafter described in the description of FIG. 3) regarding the maintenance and operation of apparatus 11.

Mail piece 20 is mailed and subsequently received by the data center.

The data center includes a code reader 21, a processor 22 that is coupled to reader 21 and a display 23 that is coupled to processor 22. Reader 21 reads the information contained on mailpiece 20 and transmits this information to processor 22. Reader 21 is a code scanner such as a laser scanner that is appropriately programmed. Such code scanners are commercially available from Welsh Allyn Inc. and Symbol Technologies Inc. The above code scanners have processors that are programmed with logic that allows decoding of a code being scanned. Processor 22 processes the information and displays the information on display 23.

Figure 2:
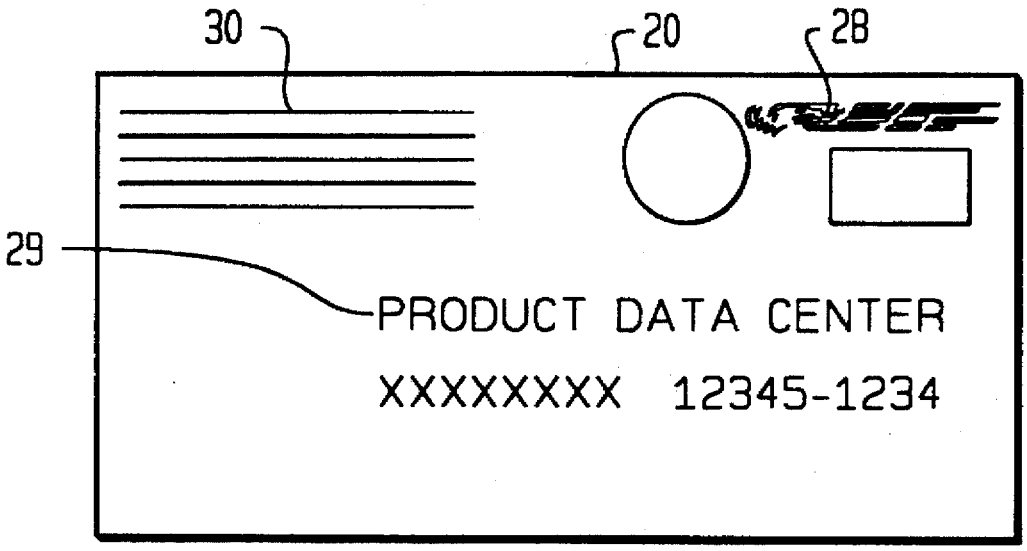
FIG. 2 is a drawing of the front of a mailpiece that is printed by printer 15.

FIG. 2 is a drawing of the front of a mailpiece 20 that is printed by printer 15. Mailpiece 20 has a postal indicia 28 affixed thereto as well as a the data center's address 29 and the return address 30.

Figure 3:
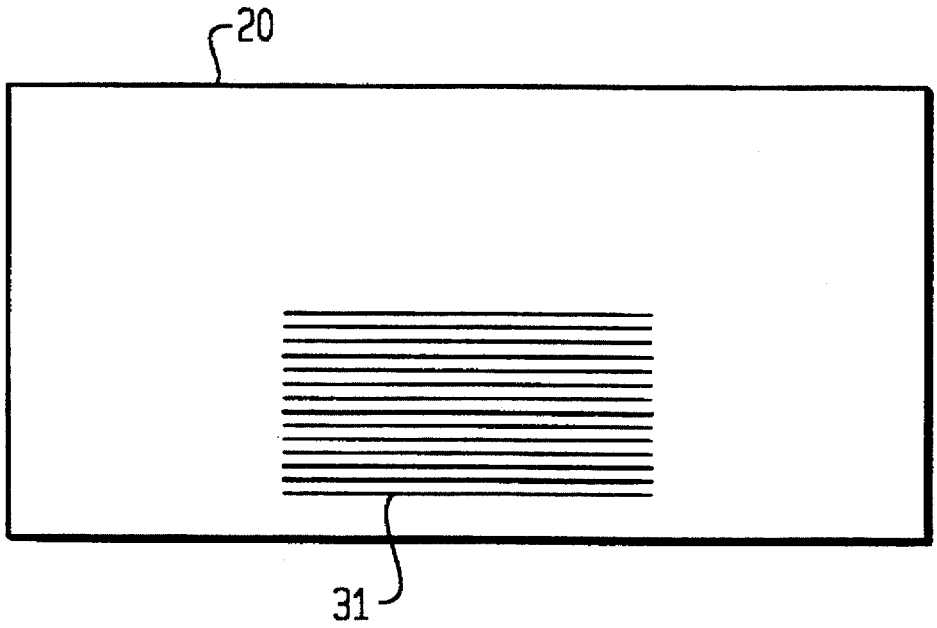
FIG. 3 is a drawing of the back of a mailpiece that is printed by printer 15.

FIG. 3 is a drawing of the back of a mailpiece 20 that is printed by printer 15. Printer 15 will imprint on the back of mailpiece certain information that pertains to the operation of postal dispensing apparatus 11. The information may include the weight, size, class, thickness, etc. of the mailpieces processed by apparatus 11 as well as information concerning the time, amount of hours apparatus 11 was utilized as well as the various features of apparatus 11 that was used i.e., sorting, weighing, stuffing, etc. It will be obvious to one skilled in the art that additional information about apparatus 11 may be printed by printer 15. The information 31 that is affixed to mailpiece 20 may be an encrypted code. The encrypted code can be a one dimensional code such as a bar code, or it can be a two dimensional code, also known as a dense code, such as those is developed and licensed by Symbol Technologies Inc. and Data Matrix Corporation. Whether a one dimensional code or a two dimensional code is used, the code that is selected should be a code that is readily readable by code reader 21.

In operation processors 12 and 22 will be programmed with an encryption algorithm, as is known in the art. Reference can be had to U.S. Pat. Nos. 4,853,961, 5,073,935 and 5,142,577 wherein suitable encryption schemes are disclosed. In addition, a standard encryption scheme, such as the RSA encryption technique, can also be used for the purpose of programming processors 12 and 22.

Figure 4:
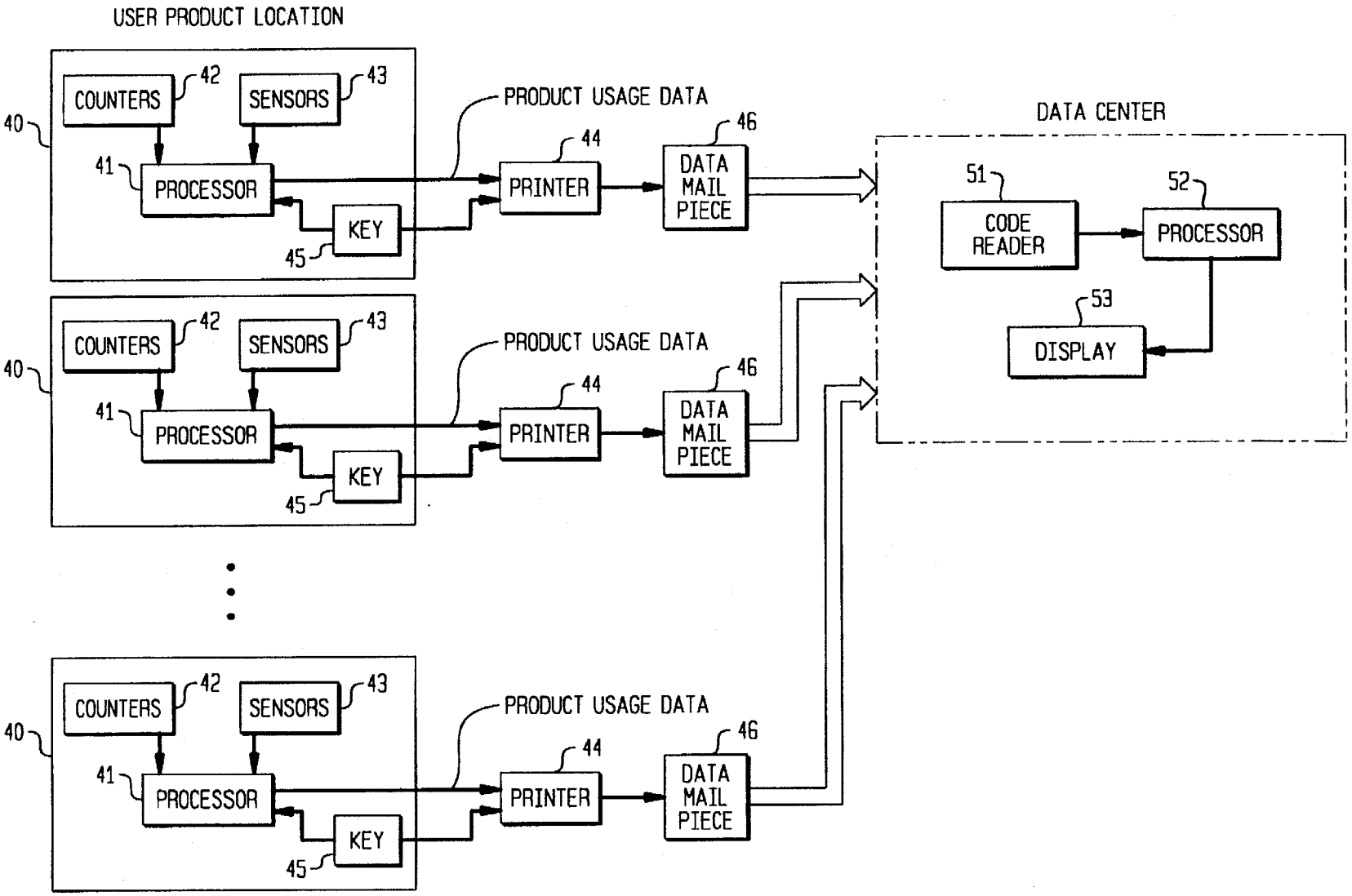
FIG. 4 is a drawing of an alternate embodiment of this invention.

FIG. 4 is a drawing of an alternate embodiment of this invention. A plurality of apparatus 40 are located at one or more user locations. Each apparatus 40 includes: a processor 41; one or more counters 42 that are coupled to processor 41; one or more sensors 43 that are coupled to processor 41; and a data activation key 45 that is coupled to processor 41 and printer 44.

Processor 12 may be any of a number of commercially available processors such as a model 80386 microprocessor available from Intel Corporation or a TMS 320/C25 processor available from Texas Instruments Corporation. One or more counters 42 are connected to processor 41 and one or more sensors are connected to processor 41. Counters 42 will count various parameters about the product produced by apparatus 40. Sensors 43 sense various characteristics of apparatus 40. For instance, sensors 43 may sense the weight, size, thickness, etc. of the product being produced by apparatus 40.

Processor 41 is in communication with printer 44. Printer 44 will receive commands from processor 41 for the data which is printed on mailpiece 46.

Periodically, apparatus 40 is inspected by the enabling of activation key 45. Activation key 45 may be a physical key or a code that is inputted to processor 41 to output information (The information may be in the same format as information 31 described in the description of FIG. 3) regarding the maintenance and operation of apparatus 40.

Mail pieces 46 are mailed and subsequently received by the data center.

The data center includes a code reader 51, a processor 52 that is coupled to reader 51 and a display 53 that is coupled to processor 52. Reader 51 reads the information contained on mailpieces 46 and transmits this information to processor 52. Reader 51 is a code scanner such as a laser scanner that is appropriately programmed. Such code scanners are commercially available from Welsh Allyn Inc. and Symbol Technologies Inc. The above code scanners have processors that are programmed with logic that allows decoding of a code being scanned. Processor 52 processes the information and displays the information on display 53.

The above specification describes a new and improved system for monitoring machines and equipment. It is realized that the above description may indicate to those skilled in the art additional ways in which the principles of this invention may be used without departing from the spirit. It is, therefore, intended that this invention be limited only by the scope of the appended claims.

What is claimed is:

1. A postal monitoring system that determines the amount and type of usage of mailing machines without having a representative of the mailing machine physically inspect the mailing machine, said system comprises:

a) a processor having an encoding scheme programmed therein for translating the amount and type of usage of the mailing machine including information on the features used by the user of the mailing machines when preparing mailings, received by said processor into coded form;

b) an account meter in communication with said processor for exchanging data with said processor;

c) a usage meter in communication with said processor for exchanging data with said processor;

d) a printer in communication with said processor, said printer prints an encoded message on a mailpiece containing the data received by said processor from said account meter to meter said information on the usage of features and usage of said usage meter;

e) means for delivering the mailpiece;

f) means coupled to said delivering means for reading the encoded message;

g) means coupled to said reading means for processing the encoded message; and h) means coupled to said processing means for displaying the encoded message in a human readable format so that information regarding the mailing machines may be used for market research and/or preventive maintenance scheduling.

2. The monitoring system claimed in claim 1, further including activation means coupled to said processor for causing said processor to transmit an encoded message to said printer.

3. The monitoring system claimed in claim 2, wherein said activation means is a key.

4. The monitoring system claimed in claim 1, wherein said processor records the number of mail pieces processed.

5. The monitoring system claimed in claim 4, wherein said processors records the weight and size of the mail piece.

6. The monitoring system claimed in claim 5, wherein said processor records the rating and time of franking of the mail piece.

7. A monitoring system that determines the amount and type of usage of machines and equipment without having a representative of the machines and equipment physically inspect the machines and equipment, said system comprises:

a) a plurality of machines and equipment each containing, a processor having an encoding scheme programmed therein for translating the amount and type of usage of the machines and equipment including information on the features used by the user of the machines and equipment when utilizing the machines and equipment received by said processor into coded form;

one or more sensors in communication with said processor for exchanging data with said processor;

one or more counters in communication with said processor for exchanging data with said processor;

a printer in communication with said processor, said printer prints an encoded message on a mailpiece containing the data received by said processor from said account meter to meter said information on the usage of features of said usage meter;

b) means for delivering the mailpiece; and c) a data center containing;

means coupled to said delivering means for reading the encoded message;

means coupled to said reading means for processing the encoded message; and means coupled to said processing means for displaying the encoded message in a human readable format so that information regarding the machines and equipment may be used for market research and/or preventive maintenance scheduling.

8. The monitoring system claimed in claim 7, further including activation means coupled to said processor for causing said processor to transmit an encoded message to said printer.

9. The monitoring system claimed in claim 8, wherein said activation means is a key.

* * * * *